US005649844A

United States Patent [19]

Caricof et al.

[11] Patent Number: 5,649,844

[45] Date of Patent: Jul. 22, 1997

[54] DUAL DRIVE FOR POWER BOATS

[75] Inventors: Philip C. Caricof, Costa Mesa, Calif.; Neil A. Newman, Omro, Wis.; Warren H. Robbins, Fountain Valley; Lawrence C. Smith, Santa Barbara, both of Calif.

[73] Assignee: Hydra Drive System, Inc., Costa Mesa, Calif.

[21] Appl. No.: 589,486

[22] Filed: Jan. 22, 1996

[51] Int. Cl.[6] ..... B63H 20/14

[52] U.S. Cl. ..... 440/75; 464/160; 477/178; 192/150; 474/88; 384/255

[58] Field of Search ..... 440/1, 75, 79, 440/80, 83, 84, 85, 87, 62, 3, 4, 58, 49; 474/88, 86, 84; 464/23, 30, 160; 384/255; 477/177, 178, 181; 192/56.56, 150

[56] References Cited

U.S. PATENT DOCUMENTS

| | | | |
|---|---|---|---|
| 2,232,545 | 2/1941 | Lum | 192/150 |
| 2,402,197 | 6/1946 | Kincannon | 440/49 |
| 2,689,891 | 9/1954 | Silver et al. | 192/150 |
| 3,072,090 | 1/1963 | Yarbrough | 440/79 |
| 4,565,532 | 1/1986 | Connor | 440/57 |
| 4,728,308 | 3/1988 | Weismann | 440/57 |
| 4,775,342 | 10/1988 | Connor et al. | 440/57 |
| 4,889,436 | 12/1989 | Lynn, Jr. | 384/255 |
| 5,074,814 | 12/1991 | Hogg | 440/79 |

FOREIGN PATENT DOCUMENTS

| | | | |
|---|---|---|---|
| 1236411 | 6/1960 | France | 440/58 |

*Primary Examiner*—Edwin L. Swinehart

*Attorney, Agent, or Firm*—Pretty, Schroeder & Poplawski

[57] ABSTRACT

A drive system for a boat having a hull with an inboard motor and two spaced drive units mounted in the hull, including a dual drive package having a housing with first and second output shafts mounted in bearings in the housing and an input shaft mounted in bearings in the housing between the output shafts, first and second drive chain sprockets mounted on and spaced axially along the input shaft, a third drive chain sprocket mounted on the first output shaft, a fourth drive chain sprocket mounted on the second output shaft, a first drive chain coupling the first and third sprockets, a second drive chain coupling the second and fourth sprockets, and arrangements for connecting the input shaft to the motor and each of the output shafts to a respective drive unit. The drive system may further include first and second torque limiters for connecting between the respective drive units.

8 Claims, 5 Drawing Sheets

DUAL DRIVE FOR POWER BOATS

BACKGROUND OF THE INVENTION

This invention relates to drive systems for power boats, and in particular to a new and improved dual drive package for operation between a motor and a pair of drive units mounted in the boat.

Several forms of drive units suitable for this use are shown in U.S. Pat. Nos. 4,565,532; 4,728,308; and 4,775,342.

In a typical dual drive package, there is an input shaft driven by the motor and a pair of output shafts connected to the drive units at the transom, with some form of gearing in the dual drive package for driving the two outputs from the input. There are a number of disadvantages with this configuration. The two output shafts are counter-rotating, and the spacing between the shafts is dictated by those gears which are available for the desired drive ratios. The output of most engines and the input of most drives (both stern drives and jet drives) all rotate in the same direction. If the direction of rotation of the output shafts are counter-rotating or rotating opposite to the engine, some additional complication must be included to correct this problem.

It is an object of the present invention to provide a new and improved dual drive package in which the input shaft is coupled to the output shaft by sprockets and chains, resulting in rotation of the two output shafts in the same direction. Also, the spacing between shafts is not dictated by the sprockets utilized so that selection of spacing and selection of drive ratios are independent of each other. Also, the vertical spacing of the axes of the shafts can be selected to accommodate the particular motor, hull and drive units being utilized. With the chain drive the vertical spacing can be modified independently of the spacing of the output shafts. With gears, as you change the vertical spacing of the input and output shafts you also affect (change) the spacing between the output shafts in order to maintain the single fixed gear centerlines.

A particular advantage utilizing the sprocket and chain drives lies in the fact that the axes of rotation for the output shaft can be varied slightly before or after installation by rotating the bearing housings for the output shafts a few degrees.

While propeller output drive units are shown in the above-identified patents and in the drawings of this application, the invention is equally applicable to jet drive units.

A problem sometimes encountered with dual drive packages is the possibility of a failure in one of the drive units, resulting in a substantial increase in load on the other drive unit. By way of example, with a motor providing 400 horse power at its output, the dual drive package normally would be designed to handle 200 horse power for each of the two drive units. When there is some failure in one of the drive units, the entire torque output of the motor is coupled to the still operating drive unit, which can result in serious damage.

There are several means of limiting the torque applied to the unit. One would be the shear pin. This would protect the unit from overloading, but would be unsatisfactory because the unit would become non-functional when the pin sheared. Another would be the slip clutch. This would allow the drive to still function, but would require additional complication to dissipate the heat from the slipping mechanism. The most satisfactory means of limiting the torque to the drive unit and still allow it to function is to provide a mechanism sensitive to the torque and a means of limiting the engine power to a predetermined, non-destructive torque level.

It is another object of the invention to provide such torque limiters which can be connected in line between the output of the dual drive package and the input of the drive unit, which torque limiters can function to reduce engine output when torque limiting is desired.

These and other objects, advantages, features and results will more fully appear in the course of the following description.

SUMMARY OF THE INVENTION

The presently preferred embodiment of the dual drive package of the invention includes a housing with first and second output shafts mounted in bearings in the housing and an input shaft mounted in bearings in the housing between the output shafts, first and second drive chain sprockets mounted on the input shaft spaced axially along the input shaft, a third drive chain sprocket mounted on the first output shaft, a fourth drive chain sprocket mounted on the second output shaft, a first drive chain coupling the first and third sprockets, a second drive chain coupling the second and fourth sprockets, and means for connecting the input shaft to the motor and for coupling each of the output shafts to a respective drive unit.

The preferred form further provides for carrying the bearings of the output shafts in bearing caps attached to the housing, with each of the bearing caps having an inner circular surface for receiving a bearing and an outer circular surface for engaging the housing, with the inner and outer circular surfaces being non-concentric for adjusting shaft spacings by rotation of the bearing cap.

The invention further includes first and second torque limiters, and means for connecting the first torque limiter between the first output shaft and one of the spaced drive units, and for connecting the second torque limiter between the second output shaft and the other of the spaced drive units.

Each of the torque limiters preferably includes an input shaft having a plurality of projecting dogs or ears spaced about the input shaft, an output shaft having a corresponding plurality of ears spaced about the output shaft, with the ears of one shaft positioned between the ears of the other shaft in spaced relation, springs positioned between selected pairs of interspaced ears, and a lever carried on one shaft and engaging the other shaft, with the lever pivoting on the one shaft when the one shaft rotates with respect to the other of the shafts producing a control motion for a boat engine.

DESCRIPTION OF THE PREFERRED EMBODIMENT

Figure 1:
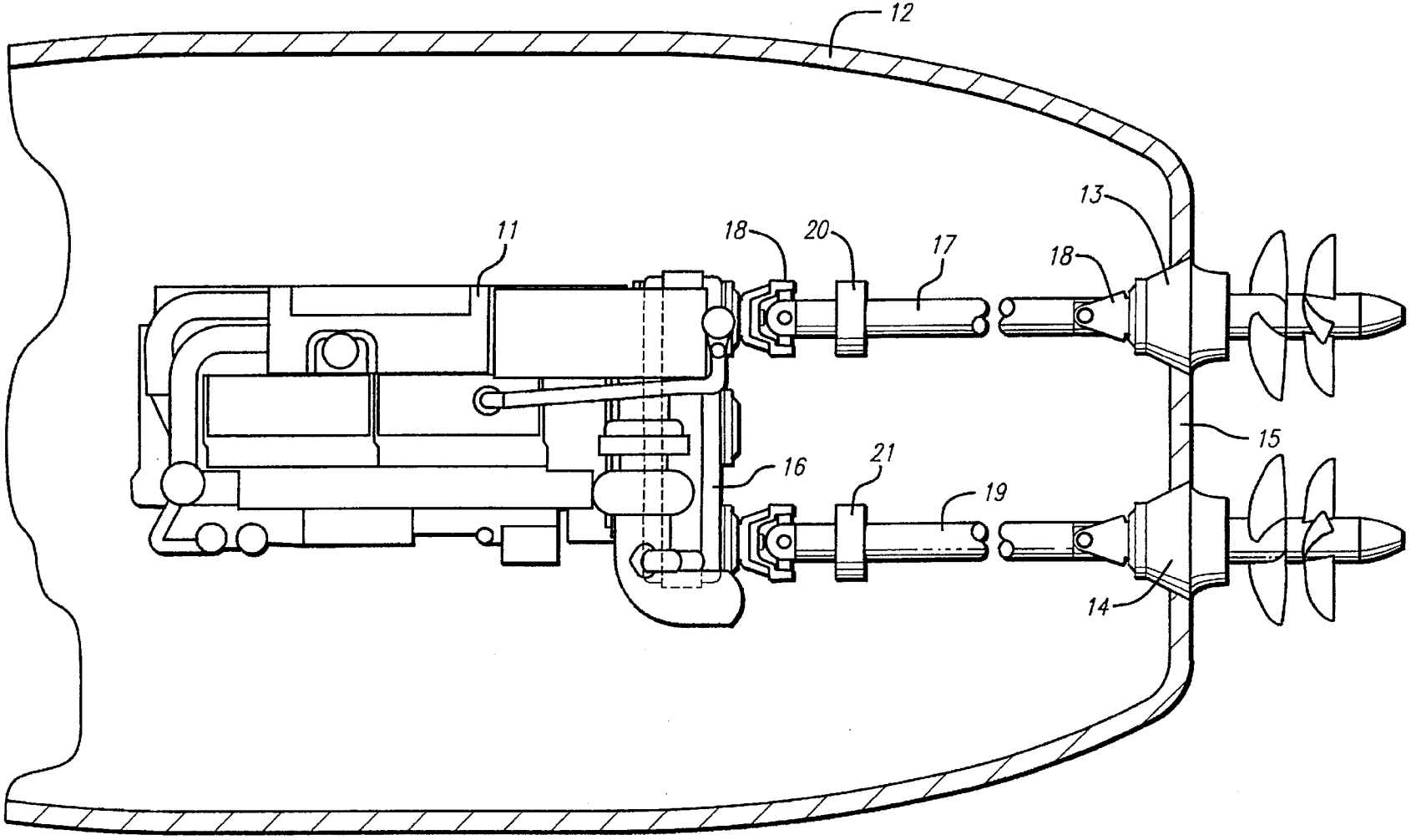
FIG. 1 is a plan view from above of the rear portion of a boat hull with a motor mounted in the hull, two drive units mounted in the hull transom, and a dual drive package positioned at the output end of the motor, the dual drive package incorporating the presently preferred embodiment of the invention.
Figure 2:
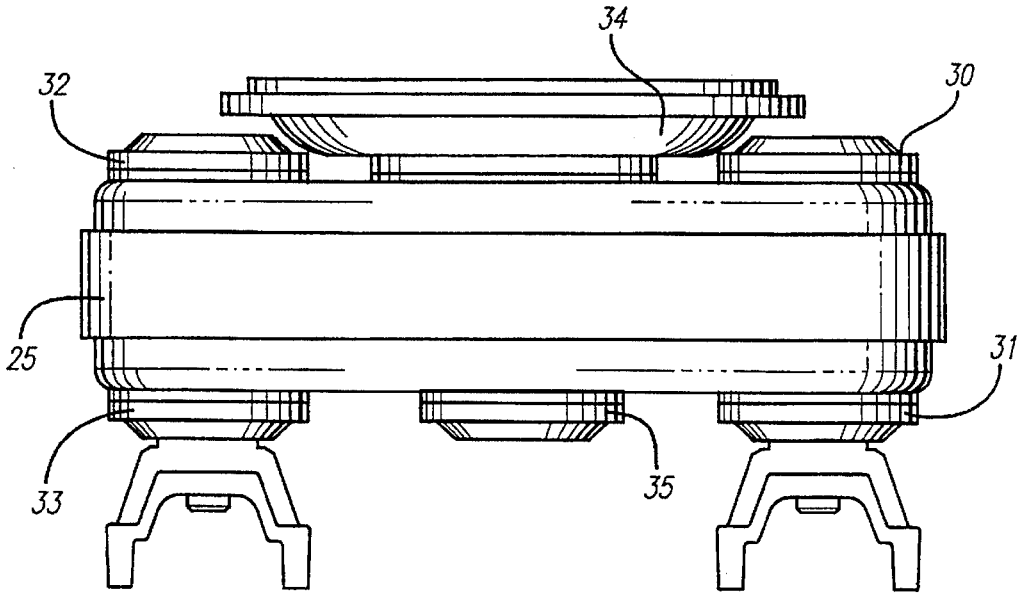
FIG. 2 is an enlarged top view of the dual drive package of FIG. 1.
Figure 3:
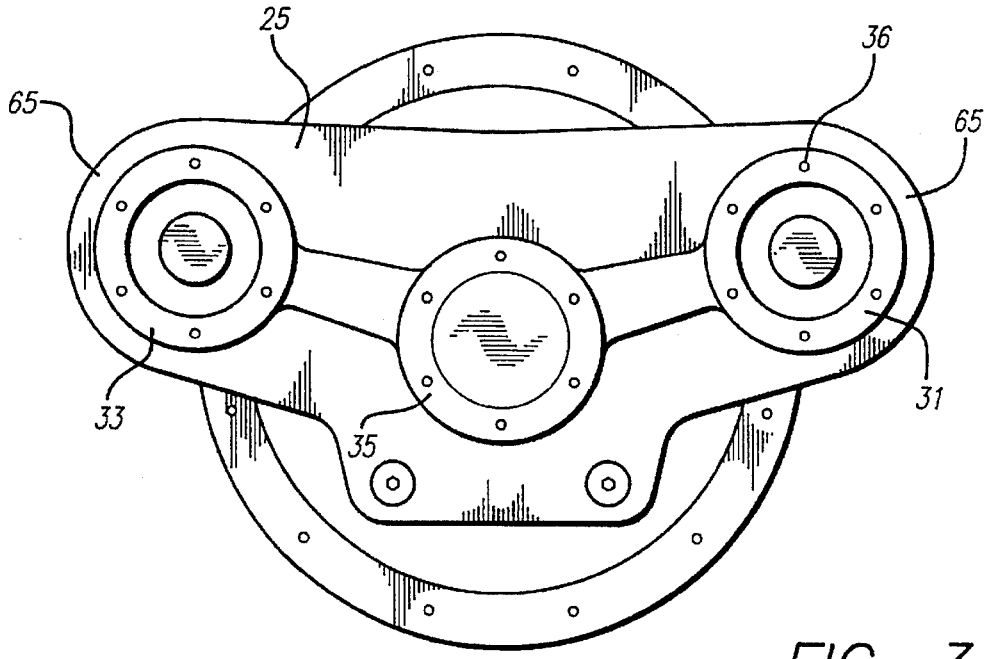
FIG. 3 is an output end view of the dual drive package of FIG. 2.

In FIG. 1, a conventional motor 11 is mounted in the aft end of the hull 12 of a boat. Conventional drive units 13, 14 are mounted in the transom 15 at the aft end of the hull. Propeller output drive units are shown in FIG. 1, but the invention is equally useful with jet drive units.

A dual drive package 16 incorporating the invention is mounted on the output end of the motor. The drive unit 13 is coupled to the drive package by a drive shaft 17, typically with universal couplings 18 at each end, and drive unit 14 is similarly coupled by a shaft 19. A torque limiter 20 is connected between the drive package 16 and the drive unit 13, and a torque limiter 21 is similarly connected for the drive unit 14. The torque limiters are indicated diagramatically in FIG. 1 and will be described in greater detail later. The torque limiters may be mounted directly at the output end of the dual drive package 16 or at the input end of the drive units 13, 14, or in between, as illustrated in FIG. 1.

Figure 4:
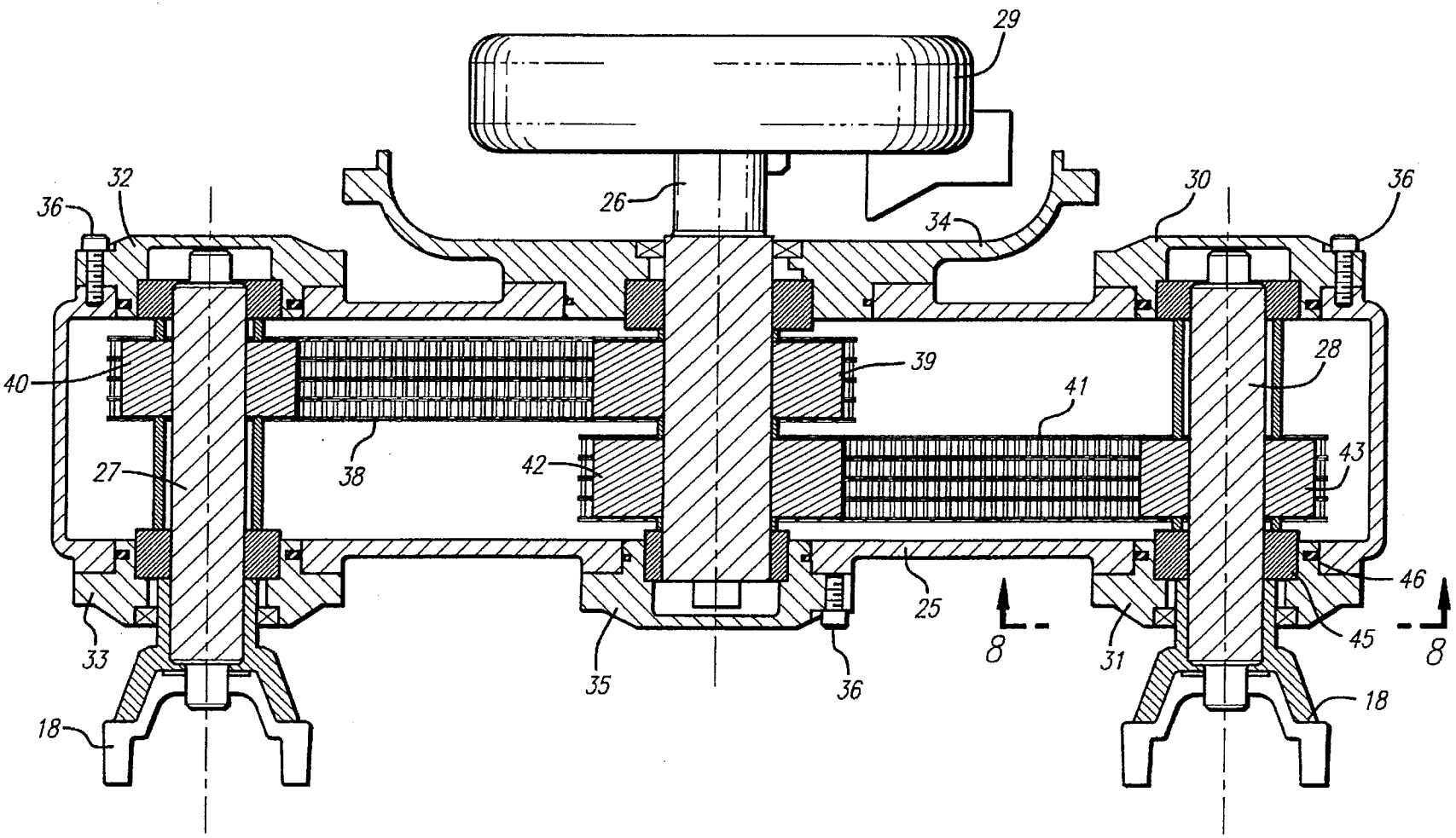
FIG. 4 is an enlarged sectional view of the dual drive package of FIG. 2.

The dual drive package 16 is shown in sectional view FIG. 4 and includes a housing 25, an input shaft 26 and output shafts 27, 28.

The input shaft 26 is driven by the motor, typically by a coupling 29. The output shafts are connected to the respective drive units, typically through the universal couplings 18 previously identified. The shafts are mounted in the housing in conventional bearings, carried in bearing caps 30–35, with the bearing cap 34 typically providing a shell for connection to the motor. The output shaft 27 is driven from the input shaft 26 by a drive chain 38 running on a sprocket 39 mounted on the input shaft 26 and another sprocket 40 running on the output shaft 27. The output shaft 28 is similarly driven by a drive chain 41 running on a sprocket 42 on the input shaft 26 and another sprocket 43 on the output shaft 28.

The drive chain and sprockets are conventional products and are ideally suited for utilization with the dual drive package of the present invention. With this arrangement, the positioning of the input shaft and the two output shafts is not dictated by gear sizes, gear ratios, required spacings between shaft axes, and the like.

The designer can select the locations of the output shafts with respect to the input shaft to fit other desired configurations for the boat. The output shafts can be above the input shaft or below the input shaft, or in line horizontally. The output shafts may be placed close to the input shaft or may be placed wide apart from the input shaft, as desired.

Each of the bearing caps will have a circular inner surface 45 for receiving the bearing, and a circular outer surface 46 for engaging the mating surface in the housing 25. In conventional installations, these two surfaces 45, 46 on the bearing cap are concentric. However, in the dual drive package of the present invention, the bearing caps for the output shafts may have a different arrangement. The two surfaces 45, 46 of the bearing cap may be made non-concentric. With this arrangement, rotation of the pair of bearing caps for an output shaft will move the axis of the output shaft laterally with respect to the axis of the input shaft providing a further adjustment in spacing between the input and output shafts. In the embodiment illustrated, the bearing caps are attached by six bolts 36, uniformly spaced around the bearing cap, providing six different possible positions for the bearing cap with respect to the housing. With knowledge of the dimensions of a specific design, the user can determine how much lateral motion is achieved with each sixty degree rotation of the bearing caps with respect to the housing. The chain and sprocket configuration permits this usage without requiring any change in gearing or belting. Also with such knowledge the designer can arrange the holes so that the user can select or change ratios (sprocket and chain size) without the requirement of the user to know or measure the required shaft centerline distance. The various holes can be marked or labeled to designate specific predetermined center distances.

Figure 8:
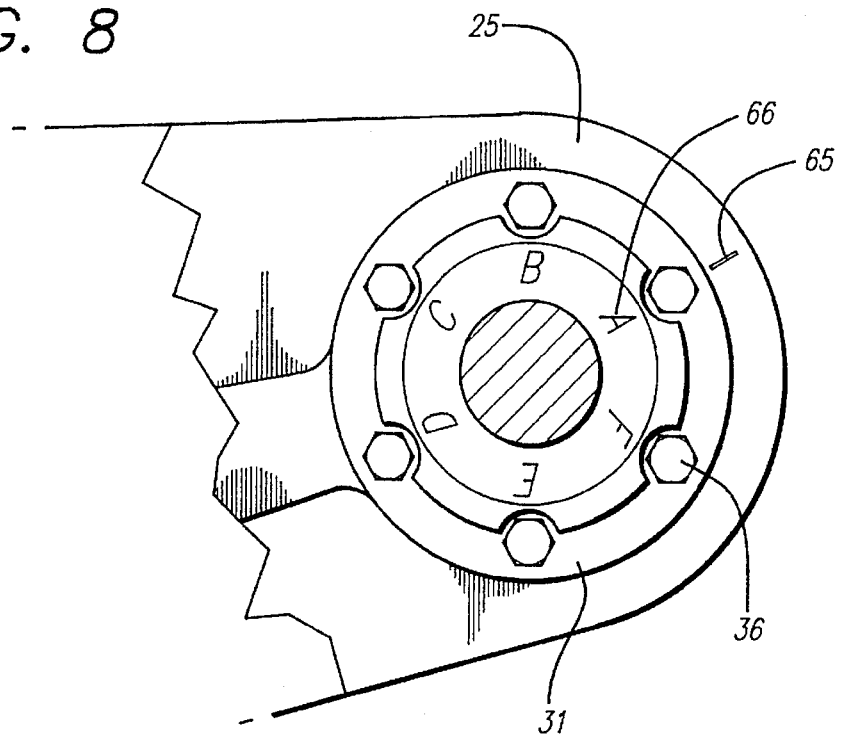
FIG. 8 is an enlarged partial view taken along the line 8—8 of FIG. 4 showing indicia for positioning bearing caps on the housing and, FIG. 9 is a sectional view of FIG. 8.
Figure 9:
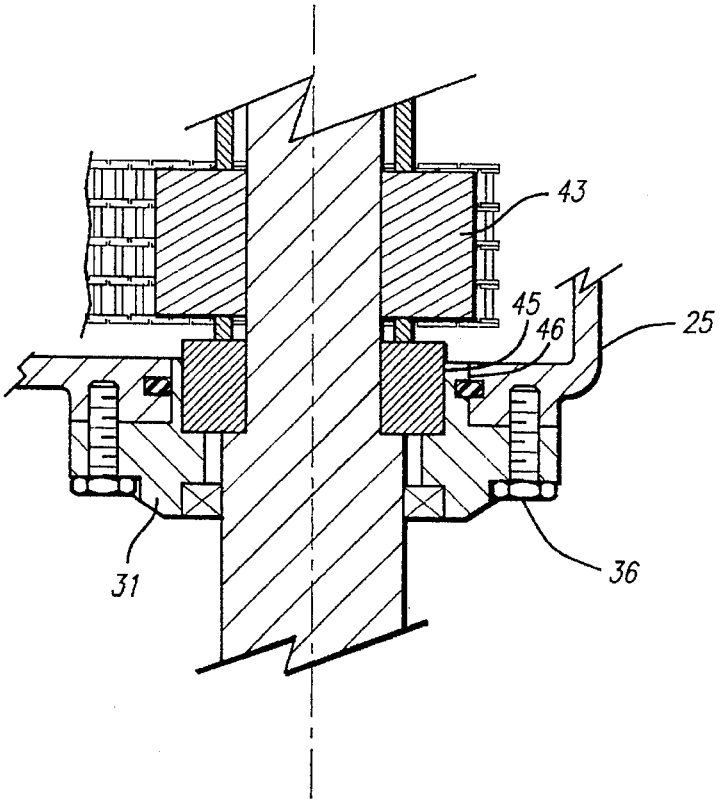

FIG. 8 shows one form of indicia for positioning the bearing caps on the housing to achieve a selected center-to-center distance for the shaft 26 and the shafts 27, 28. A mark is placed on the housing 25, here the line 65, adjacent one of the bolt holes, and additional marks 66 are placed on the bearing cap 31, here the letters A–F, adjacent the bolt holes, with a different mark or letter for each bearing cap bolt hole. The same markings are used for bearing caps 30, 32 and 33.

The center-to-center distance for each of the marks 66 is known, and can be provided in a printed table. The person assembling the drive package can rotate the bearing caps to position a preselected letter of the marks 66 opposite the housing mark 65 and obtain the desired shaft center-to-center distance without actually measuring the spacing.

The housing for the dual drive package preferably is made separate as shown in the drawings. However the housing could be formed as a part of the motor housing, or could even be formed as part of the housings for the drive units, but neither of these is a preferred configuration.

Figure 7:
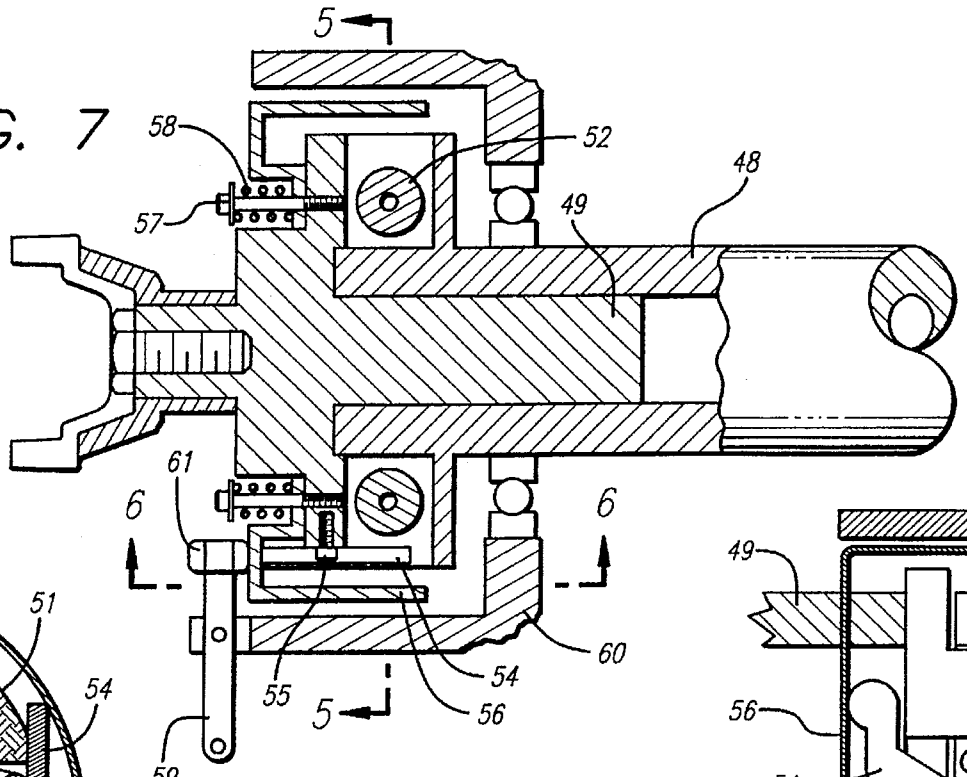
FIG. 7 is an enlarged sectional view of the torque limiter of FIG. 5.
Figure 6:
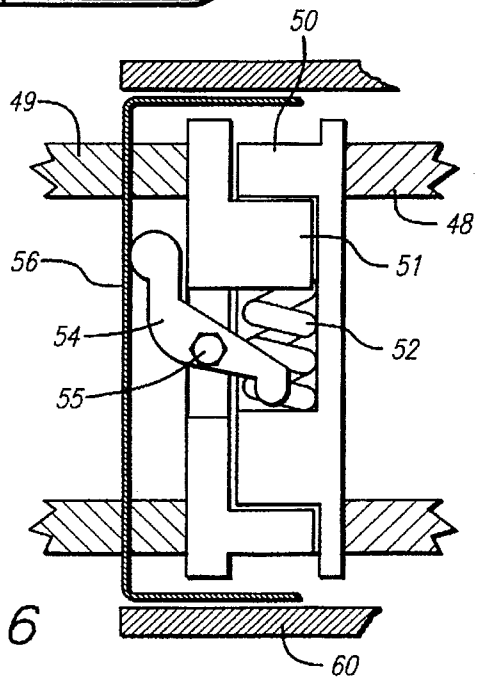
FIG. 6 is a side view of the torque limiter of FIG. 5.
Figure 5:
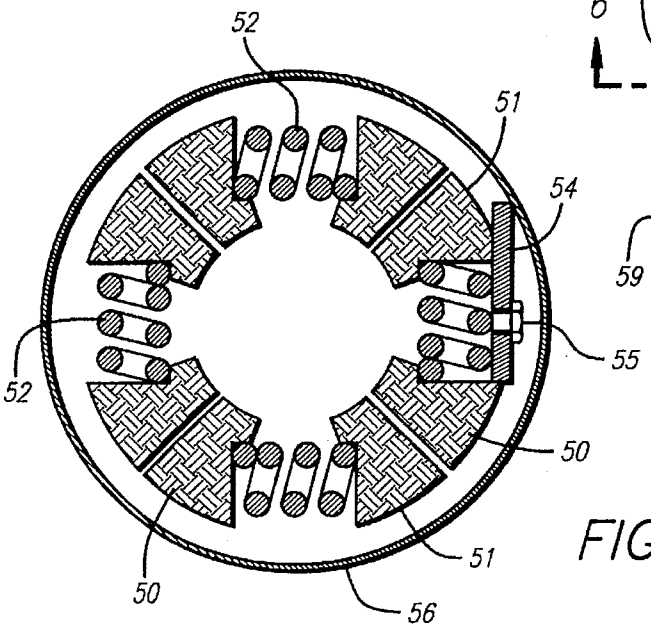
FIG. 5 is a enlarged cross-sectional view of the torque limiter shown diagramatically in FIG. 1.

Details of the preferred embodiment of the torque limiter are shown in FIGS. 5, 6 and 7. An input shaft 48 and an output shaft 49 are mounted in alignment, with projecting dogs or ears 50 spaced about the input shaft and projecting ears 51 spaced about the output shaft. The ears of one of the shafts are positioned between the ears of the other of the shafts, in spaced relation, as seen in FIG. 5. Springs 52 are positioned between pairs of the ears and normally maintain the ears in the desired spaced relationship. In normal operation, the angular relation between the input shaft and the output shaft is maintained constant as the shafts rotate, driving the drive unit from the motor. In the event that the angular relation changes, as a result of a change in torque loading on one of the shafts relative to the torque loading on the other shaft, the springs maintaining the spaced relationship of the ears will be overridden and there will be an angular motion between the two shafts. This angular motion is utilized to provide a control for the motor. The most likely situation is where there would be a failure in one of the drive units with a resultant zero torque in the output shaft of the torque limiter, and it would be highly desirable to be able to reduce the motor output torque as rapidly as possible.

In the preferred embodiment illustrated, a lever 54 is pivotally mounted on the output shaft 49 by a bolt 55. A cup 56 is carried on the output shaft 49 on one or more bolts 57, and is free to move axially along the shafts, being urged to the right as shown in FIG. 7 by springs 58. Axial motion of the cup 56 produced by the lever 54 drives another lever 59 carried on the housing 60, with a wheel 61 preferably at the inner end of the lever for engaging the cup. This lever 59 projects outward from the housing for providing a control motion for the motor. The form of linkage between the lever 59 and the motor will depend upon the particular motor construction and installation.

We claim:

1. In a drive system for a boat having a hull with an inboard motor and two spaced drive units mounted in the hull, the improvement comprising a dual drive package having:

a housing with first and second output shafts mounted in bearings in the housing and an input shaft mounted in bearings in the housing between said output shafts;

first and second drive chain sprockets mounted on said input shaft spaced axially along said input shaft;

a third drive chain sprocket mounted on said first output shaft;

a fourth drive chain sprocket mounted on said second output shaft;

a first drive chain coupling only said first and third sprockets;

a second drive chain coupling only said second and fourth sprockets;

means for drivingly connecting said input shaft to the motor; and means for coupling each of said output shafts to a respective drive unit.

2. A dual drive package as defined in claim 1 wherein said bearings of said output shafts are carried in bearing caps attached to said housing, with each of said bearing caps having an inner circular surface for receiving a bearing and an outer circular surface for engaging said housing, with said inner and outer circular surfaces being non-concentric.

3. A dual drive package as defined in claim 2 wherein said bearing caps and said housing have mounting holes for fasteners for attaching said caps to said housing, said bearing caps having indicia adjacent the mounting holes indicating the center distance of the cap for the mounting hole.

4. A drive system as defined in claim 1 including first and second torque limiters, first means for connecting said first torque limiter between said first output shaft and one of the spaced drive units, and second drive means for connecting said second torque limiter between said second output shaft and the other of the spaced drive units, each of said torque limiters including means for providing a control motion for connection to the motor for reducing the output of said motor.

5. In a drive system for a boat having a hull with an inboard motor and two spaced drive units mounted in the hull, the improvement comprising a dual drive package having:

a housing with first and second output shafts mounted in bearings in the housing and an input shaft mounted in bearings in the housing between said output shafts;

first and second drive chain sprockets mounted on said input shaft spaced axially along said input shaft;

a third drive chain sprocket mounted on said first output shaft;

a fourth drive chain sprocket mounted on said second output shaft;

a first drive chain coupling said first and third sprockets;

a second drive chain coupling said second and fourth sprockets;

means for connecting said input shaft to the motor;

means for coupling each of said output shafts to a respective drive unit;

with said bearings of said output shaft carried in bearing caps attached to said housing, with each of said bearing caps having an inner circular surface for receiving a bearing and an outer circular surface for engaging said housing, with said inner and outer circular surfaces being non-concentric;

said bearing caps and said housing having mounting holes for fasteners for attaching said caps to said housing, said bearing caps having indicia adjacent the mounting holes indicating the center distance of the cap for the mounting hole;

first and second torque limiters;

first means for connecting said first torque limiter between said first output shaft and one of the spaced drive units; and second drive means for connecting said second torque limiter between said second output shaft and the other of the spaced drive units;

each of said torque limiters including in combination:

an input shaft having a corresponding plurality of projecting ears spaced about said input shaft;

an output shaft having a corresponding plurality of ears spaced about said output shaft;

each of said ears of one of said shafts being positioned between said ears of the other of said shafts in spaced relation;

springs positioned between selected pairs of said inter-spaced ears; and a first lever carded on one of said shafts and engaging the other of said shafts, said lever pivoting on said one shaft when said one shaft rotates with respect to the other of said shafts producing a control motion.

6. A system as defined in claim 5 including a cup member mounted on said one shaft for axial movement relative to said shafts and engageable with said first lever to translate said cup axially when one of said shafts rotates relative to the other of said shafts, and a second lever mounted on said housing and engageable with said cup member for driving of said second lever by said first lever.

7. A torque limiter for connecting between a motor and a drive unit, said torque limiter including in combination:

a housing;

an input shaft carried in said housing for rotation and having a plurality of projecting ears spaced about said input shaft;

an output shaft having a corresponding plurality of ears spaced about said output shaft;

each of said ears of one of said shafts being positioned between said ears of the other of said shafts in spaced relation;

springs positioned between selected pairs of said inter-spaced ears; and a first lever carried on one of said shafts and engaging the other of said shafts, said lever pivoting on said one shaft when said one shaft rotates with respect to the other of said shafts producing a control motion for connection to the motor for reducing the output of said motor without shutting off said motor.

8. A torque limiter for connecting between a motor and a drive unit, said torque limiter including in combination:

a housing;

an input shaft carried in said housing for rotation and having a plurality of projecting ears spaced about said input shaft;

an output shaft having a corresponding plurality of ears spaced about said output shaft;

each of said ears of one of said shafts being positioned between said ears of the other of said shafts in spaced relation;

springs positioned between selected pairs of said interspaced ears; and a first lever carried on one of said shafts and engaging the other of said shafts, said lever pivoting on said one shaft when said one shaft rotates with respect to the other of said shafts producing a control motion;

a cup member mounted on said one shaft for axial movement relative to said shafts and engageable with said first lever to translate said cup axially when one of said shafts rotates relative to the other of said shafts; and a second lever mounted on the other of said shafts and engageable with said cup member for driving of said second lever by said first lever.

* * * * *